US007295092B2

(12) United States Patent
Elliott et al.

(10) Patent No.: US 7,295,092 B2
(45) Date of Patent: Nov. 13, 2007

(54) GAPPED CORE STRUCTURE FOR MAGNETIC COMPONENTS

(75) Inventors: Brent Alan Elliott, Boca Raton, FL (US); Robert James Bogert, Lake Worth, FL (US); Renford LaGuardia Hanley, Wellington, FL (US)

(73) Assignee: Cooper Technologies Company, Houston, TX (US)

( * ) Notice: Subject to any disclaimer, the term of this patent is extended or adjusted under 35 U.S.C. 154(b) by 440 days.

(21) Appl. No.: 10/736,059

(22) Filed: Dec. 15, 2003

(65) Prior Publication Data

US 2005/0001707 A1 Jan. 6, 2005
US 2007/0236318 A9 Oct. 11, 2007

Related U.S. Application Data

(60) Provisional application No. 60/435,414, filed on Dec. 19, 2002.

(51) Int. Cl.
*H01F 17/06* (2006.01)
*H01F 5/00* (2006.01)

(52) U.S. Cl. ..... 336/178; 336/200

(58) Field of Classification Search ..... 336/212, 336/178, 234, 200, 83
See application file for complete search history.

(56) References Cited

U.S. PATENT DOCUMENTS 5,861,792 A * 1/1999 Ueda et al. ..... 336/234
6,154,109 A * 11/2000 Gold ..... 335/299
6,162,311 A * 12/2000 Gordon et al. ..... 156/89.11
6,433,664 B1 * 8/2002 Ishii et al. ..... 336/185

FOREIGN PATENT DOCUMENTS

JP 04042513 A * 2/1992

* cited by examiner

*Primary Examiner*—Anh T. Mai
(74) *Attorney, Agent, or Firm*—King & Spalding LLP

(57) ABSTRACT

A magnetic component includes a first monolithic core structure having a plurality of magnetic layers and at least one nonmagnetic layer separating one of the plurality of magnetic layers from another of the plurality of magnetic layers. A first opening extends through the first core structure, and a conductive element establishes a conductive path through the first opening, wherein the nonmagnetic layer separates the conductive element from one of the magnetic layers.

21 Claims, 2 Drawing Sheets

GAPPED CORE STRUCTURE FOR MAGNETIC COMPONENTS

CROSS REFERENCE TO RELATED APPLICATIONS

This application claims the benefit of U.S. Provisional Application Ser. No. 60/435,414 filed Dec. 19, 2002, the disclosure of which is hereby incorporated by reference in its entirety.

BACKGROUND OF THE INVENTION

This invention relates generally to manufacture of electronic components, and more specifically to manufacturing of magnetic components such as inductors.

A variety of magnetic components, including but not limited to inductors and transformers, include at least one winding disposed about a magnetic core. In some components, a core assembly is fabricated from ferrite cores that are gapped and bonded together. In use, the gap between the cores is required to store energy in the core, and the gap affects magnetic characteristics, including but not limited to open circuit inductance and DC bias characteristics. Especially in miniature components, production of a uniform gap between the cores is important to the consistent manufacture of reliable, high quality magnetic components.

In some instances, epoxies have been used to bond the ferrite cores used to produce the bonded core assembly for magnetic components. In an effort to consistently gap the cores, non-magnetic beads, typically glass spheres, are sometimes mixed with adhesive insulator materials and dispensed between the cores to form the gap. When heat cured, the epoxy bonds the cores and the beads space the cores apart to form the gap. The bond, however, is primarily dependant upon the viscosity of the epoxy and the epoxy to beads ratio of the adhesive mix dispensed between the cores. It has been noted that in some applications the bonded cores are insufficiently bonded for their intended use, and controlling the epoxy to glass spheres ratio in the adhesive mix has proven very difficult.

In another type of magnetic component, a non-magnetic spacer material is placed between two magnetic core halves, and the core halves are then fastened together to hold the spacer material in place. The spacer material is frequently made of a paper or mylar insulator material. Typically, the core halves and spacer are secured to one another with tape wrapped around the outside of the core halves, with an adhesive to secure the core halves together, or with a clamp to secure the core halves and keep the gap located between the core halves. Multiple (more than two) pieces of spacer material are rarely used, since the problem of securing the structure together becomes very complicated, difficult and costly.

Still another type of magnetic component includes a gap ground into one section of a core half, and remaining sections of the core half are fastened to another core half with any of the foregoing techniques.

Yet another method of creating a gap in core structures begins with a single piece core, and a slice of material is cut from the core (typically a toroid shaped core). The gap is frequently filled with an adhesive or epoxy to restore the strength and shape of the core.

Recently, composite magnetic ceramic toroids have been developed that include layered magnetic constructions separated by a nonmagnetic layer to form a gap. See, for example, U.S. Pat. No. 6,162,311. Bonding material (e.g., adhesives) and external gapping material (e.g. spacers) for magnetic core structures may therefore be eliminated.

In any of the foregoing devices, a conductor is typically placed through the core to couple energy into the core in the form of magnetic flux, and magnetic flux lines cross through and around the gap to complete a magnetic path in the core. If the conductor intersects the flux lines, a circulating current is induced in the conductor. Resistance of the conductor creates heat as the current circulates, which reduces the efficiency of the magnetic component. Moving the conductor farther away from the magnetic flux lines can reduce the amount of energy that is coupled to the conductor and hence increase the efficiency of the component, but this typically entails increasing the size of the component, which is undesirable from a manufacturing perspective.

Also, known magnetic components are typically assembled on a single core structure. When multiple inductors are employed, for example, the cores must be physically separated to prevent interference with one another in operation. Separation of the components occupies valuable space on a printed circuit board.

It is therefore desirable to provide a magnetic component of increased efficiency and improved manufacturability for circuit board applications without increasing the size of the components and occupying an undue amount of space on a printed circuit board.

BRIEF DESCRIPTION OF THE INVENTION

According to an exemplary embodiment, a magnetic component is provided. The component includes a first monolithic core structure comprising a plurality of magnetic layers and at least one nonmagnetic layer separating one of the plurality of magnetic layers from another of the plurality of magnetic layers. A first opening extends through the first core structure, and a conductive element establishing a conductive path through the first opening, wherein the at least one nonmagnetic layer separates the conductive element from one of the magnetic layers.

According to another exemplary embodiment, a magnetic component is provided. The component includes a monolithic core comprising a first core structure and a second core structure separated by an insulating layer. Each of the first and second core structures comprise a plurality of magnetic layers, at least one nonmagnetic layer separating one of the plurality of magnetic layers from another of the plurality of magnetic layers, and an opening extending therethrough for passage of a conductive element.

A gapped core structure for producing magnetic components, such as inductors, transformers, or other components is therefore provided. The core structure allows multiple magnetically gapped cores to be combined into a single structure. Bonding and external gapping material used in conventional core structures are avoided, and electrical efficiency is improved by the use of multiple small gaps (instead of one to two larger gaps) to reduce fringing flux losses in the conductor materials, and the structure allows for very tightly controlled inductance values. The gaps are placed such that the fringing flux can be placed away from the conductor, resulting in maximum efficiency, and multiple inductors may be assembled onto a single core structure, reducing overall cost and size.

DETAILED DESCRIPTION OF THE INVENTION

Figure 1:
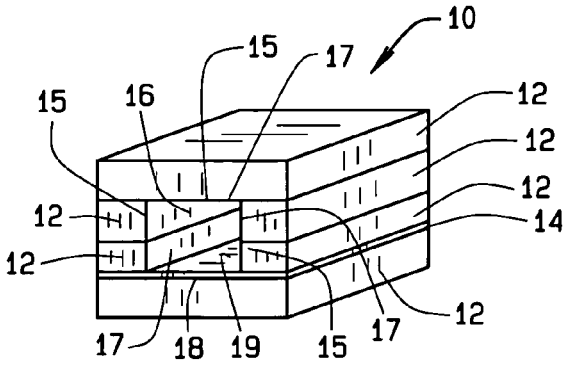
FIG. 1 is a perspective view of an exemplary gapped core structure for fabricating a magnetic component.

FIG. 1 is a perspective view of an exemplary gapped magnetic core structure 10 for magnetic components such as inductors, transformers, and other magnetic components including a gapped core structure. The core structure 10 includes a number of magnetic layers 12 in a stacked configuration, with a non-magnetic layer 14 extending between and separating two of the magnetic layers 12 to form an integrated gap therein to interrupt a magnetic path through the core structure 10.

As illustrated in FIG. 1, the core structure 10 is suited for forming a single magnetic component, such as, for example, an inductor. The core structure 10 is constructed by combining layers of green (unfired) magnetic ceramic material forming the magnetic layers 12, and a layer of a green non-magnetic ceramic core material forming the non-magnetic layer 14. The magnetic ceramic material provides the magnetic core, while the non-magnetic ceramic material functions as the gap.

A section of the layered ceramic materials of core structure 10 is removed to create an area or opening 16 therethrough for a conductor element (not shown in FIG. 1). In the illustrated embodiment, the opening 16 is substantially rectangular and is defined by peripheral edges 15 of the magnetic layers 12 and a peripheral edge 18 of the nonmagnetic layer 14. Side surfaces 17 extend from the edges 15 of the magnetic layers 15 and a top surface 19 extends from the edge 18 of the nonmagnetic layer 14 to form an interior bore through the core structure 10. In another embodiment, the opening 16 and/or the bore may be fabricated into another shaped in lieu of the rectangular shape illustrated in FIG. 3.

Once the magnetic and nonmagnetic layers 12, 14 are stacked to an appropriate thickness and bonded together, such as with a known lamination process, the opening 16 is formed according to known techniques, such as a known punching process. The core structure 10 then is fired to develop the final shape and properties of the core structure. A gapped magnetic core 10 is therefore fabricated as a monolithic structure. The gap size can be tightly controlled over large production lot sizes, providing a tightly controlled inductance value.

The monolithic structure of magnetic core structure 10 provides a number of manufacturing advantages For example, adhesive bonding and external gapping materials, together with associated expenses and difficulties, are eliminated and the monolithic structure is consequently less subject to separation. The integrated gap structure also allows for very tightly controlled inductance values, and multiple small gaps (instead of one to two larger gaps in conventional core structures) may be employed to reduce flux losses and heat losses in the conductor materials placed into the core in use. Moreover, introduction of the gap requires no machining operations. The resulting magnetic component including the core structure 10 is therefore robust and tight control of the gap width can be maintained.

A wide range of ferrite materials can be used as the magnetic medium to form magnetic layers 12 in the core structure 10. Exemplary ferrite materials include manganese zinc ferrite, and particularly power ferrites, nickel zinc ferrites, lithium zinc ferrites, magnesium manganese ferrites, and the like that have been commercially used and are rather widely available. For non-magnetic layers 14, a wide range of ceramics materials may be employed, including for example alumina, alumina glass mixtures, cordierite, cordierite glass mixtures, mullite, mullite glass mixtures, zirconia, zirconia glass mixtures, barium titanate, and other titanates, steatite, mixtures of ferrite and non-magnetic ceramics, and like non-magnetic or weakly magnetic ceramic materials which can be co-fired with ferrite materials. The addition of a glassy phase to the non-magnetic ceramics allows for modification of their sintering temperature and firing shrinkage. This is important as the non-magnetic ceramic must closely match the thermal properties of the magnetic phase, i.e., the ferrite. If the firing shrinkage of the two materials is not fairly well matched, the component may not operate satisfactorily.

While the embodiment illustrated in FIG. 1 includes three magnetic layers 12 and one non-magnetic layer 14, it is contemplated that greater or fewer magnetic layers 12 could be employed with greater or fewer non-magnetic layers 14 in alternative embodiments without departing from the scope of the present invention. Further, while the core structure 10 is illustrated as a substantially rectangular structure in FIG. 1, it is appreciated that other shapes for core structure 10 may be employed in alternative embodiments, including but not limited to toroid shapes known in the art.

The type of ferrite used in magnetic layers 12 and the thickness of non-magnetic layers 14 effects the magnetic properties of core structure 10, and ultimately the properties of the resultant magnetic component in which it is used. Power loss density, for example, can be varied by altering the starting ferrite composition, which in the case of a switching voltage regulator component is particularly advantageous to reduce power losses. The effective permeability, another important property, is controlled in large part by the thickness of the non-magnetic layer 14.

Figure 2:
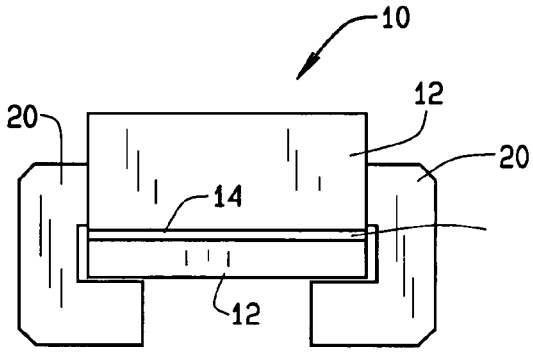
FIG. 2 is side elevational view of the core structure shown in FIG. 1 fitted with a conductor.

FIG. 2 is side elevational view of core structure 10 fitted with a conductor element 20. In an exemplary embodiment, the conductor element 20 is fabricated from a known conductive material and is formed or bent on respective ends thereof after being passed through the conductor opening 16 (shown in FIG. 1). In the illustrative embodiment of FIG. 2, the core structure 10 and conductor element 20 are well suited to form an inductor. Assembly of the core structure 10 and conductor element 20 can easily be automated as desired. Multiple conductor elements 20 may be inserted into core structures 10 as a single lead frame, then formed and trimmed to the finished product. High volume magnetic components may therefore be efficiently manufactured at comparably lower costs than, for example, known inductors.

Figure 3:
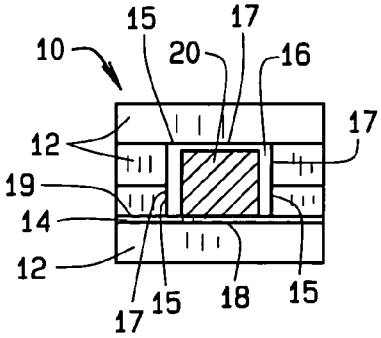
FIG. 3 is a cross sectional schematic view of the core structure and conductor shown in FIG. 2.

FIG. 3 is a cross sectional schematic view of the core structure 10 and conductor element 20 illustrating the conductor element 20 in contact with and supported by the non-magnetic layer 14 and otherwise substantially centered with respect to the conductor opening 16. That is, the conductor element 20 abuts the top surface 19 of the nonmagnetic material 14 but is spaced from the side edges 15 of the magnetic material 12 by an approximately equal distance within the opening 16. As such, a nonmagnetic gap extends directly beneath the conductor element 20 and the conductor element 20 is spaced from the inner surfaces 17 of the opening 16.

As illustrated in an exemplary embodiment in FIG. 3, the conductor element 20 is complementary in shape to conductor opening 16, and hence in one embodiment each of them are substantially rectangular in cross section. It is appreciated, however, that other cross sectional shapes of the conductor element 20 and the conductor opening 16 may be employed in alternative embodiments of the invention while achieving at least some of the benefits of the invention. In a further embodiment, it is noted that the conductor element 20 and the conductor opening 16 need not have complementary shapes to achieve the instant benefits of the invention.

Furthermore, while the conductor element 20 illustrated in FIG. 2 is shown as being inserted through the core structure 10, it is contemplated that a conductive material could alternatively be plated on a surface of the core structure 10, or, alternatively, a conductive material could be printed on the core structure 10 utilizing, for example, a known conductive ink such as those used in thick film processes.

Figure 4:
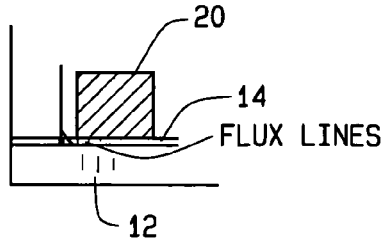
FIG. 4 is a cross sectional schematic of a portion of FIG. 3 illustrating magnetic flux lines of the core structure.

FIG. 4 schematically illustrates magnetic flux lines of the core structure 10 in use, and in particular it is noted that the conductor element 20 does not intersect the flux lines. Thus, induced current in the conductor element 20 is reduced, associated heat losses are avoided, and efficiency of the magnetic component is increased. Increased component efficiency is therefore obtained with a compact component size.

As those in the art may appreciate, the component efficiency is of most concern at higher switching frequencies. The above-described structure, with a single turn conductor element 20, is therefore particularly suited for higher frequency applications. It is appreciated however that conductive elements having multiple turns may likewise be employed in alternative embodiments of the invention.

Figure 5:
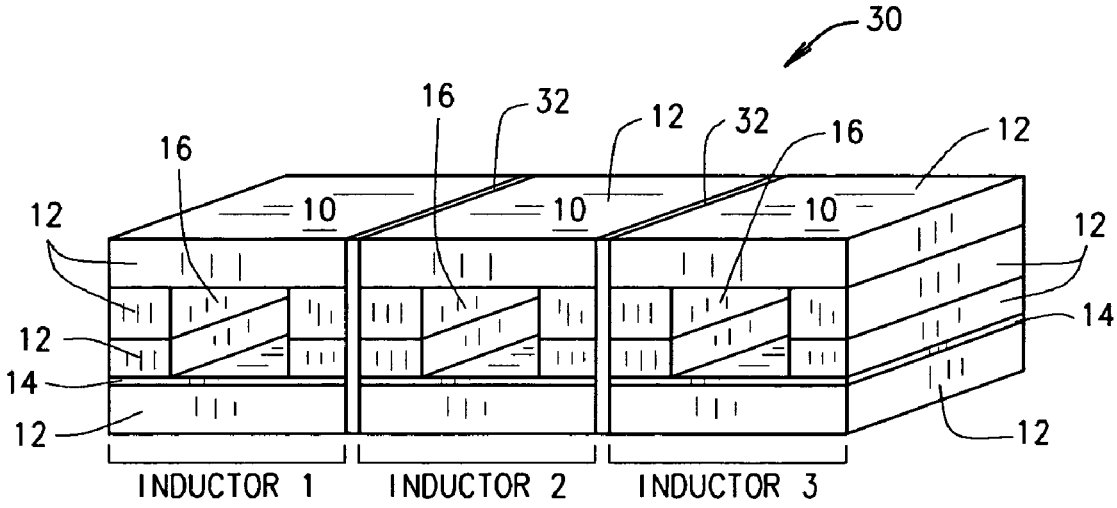
FIG. 5 is a second exemplary embodiment of a gapped core structure.

FIG. 5 is a second embodiment of a gapped core structure 30 illustrating a multiple gapped core structure. Stacking layers 12, 14 of magnetic and non-magnetic materials as described above into a single structure can create multiple magnetic components, as described above, on a singular or unitary core structure 30. Thus, two, three or more magnetic components such as inductors, for example, can be built into one core structure 30, such as that illustrated in FIG. 5 when conductive elements, such as the conductor element 20 (shown in FIGS. 2 and 3) are placed through openings 16, or when conductive elements are otherwise formed on surfaces of the core structure 30.

Utilizing a unitary integrated core structure 30 for multiple magnetic components results in lower costs since packaging and handling of a single part is lower than the cost of handling many parts. Overall system costs can also be reduced, since placement of less parts should result in a cost savings. Yet another benefit is that the core structure 30 utilizes a reduced area on a circuit board in comparison to individual magnetic components (such as the single inductor shown in FIGS. 2 and 3) in combination. Multiple inductors integrated into the single core structure 30 occupy less room than a comparable number of individual components and cores, largely because physical clearances required of individual components is not an issue with the integrated core structure 30.

As illustrated in FIG. 5, the core structure 30 is fabricated from a series of stacked magnetic layers 12 divided by at least one non-magnetic layer 14. The magnetic layers 12 extend horizontally and are stacked vertically, and a number of conductor openings 16 are formed into the stacked magnetic and nonmagnetic layers 12, 14. The conductor openings 16 are separated by a vertically extending nonmagnetic or insulating layer 32, and the vertically extending insulating layers 32 bond the vertically stacked magnetic and nonmagnetic layers 12, 14 in which each conductor opening 16 resides. Thus, the core structure 30 may be recognized as a plurality of core structures 10 (shown in FIGS. 1-4) attached to one another in a side-by-side configuration to form a larger core structure 30. The vertically extending insulating layers 32 may be bonded between stacked layers 12, 14 either before or after the openings 16 are formed, and the core structure 30 is fired as a monolithic structure into its final form.

Once completed, the conductor openings 16 are fitted with conductive elements, such as the conductor elements 20 described above, to form a plurality of magnetic components operable from the same monolithic core structure. This results in an overall less costly solution than using separate components, such as inductors, especially when automatic component placement equipment is used. The combined inductor structure on core 30 will use less space on a circuit board than multiple individual inductors since physical interference or "keep-out" areas are no longer required. Additionally, use of a single magnetic core structure 30 for multiple conductor elements allows inductance values to track one another, since the heating of individual inductors affects the other inductors on the same structure similarly.

The core structure 30 is particularly suited for a multiple voltage regulator module (VRM) that is frequently used in high performance, higher current applications. Total current delivered to the load in a VRM is the sum of each VRM section. Since many inductors can be used in a voltage regulator circuit, it is advantageous to combine more than one inductor into a single package as facilitated by the core structure 30.

While stacked layers 12, 14 of core structure 30 includes four magnetic layers 12 and one non-magnetic layer 14, it is appreciated that more than one non-magnetic layer 14 may be employed with greater or fewer magnetic layers 12 without departing from the scope of the present invention. Further, as noted above with respect to the core 10, the core structure 30 need not have a rectangular shape and need not have rectangular conductor openings to achieve the instant benefits of the invention, and hence in different embodiments a variety of shapes for overall core structure 30 and/or the conductor openings 16 may be employed.

Figure 6:
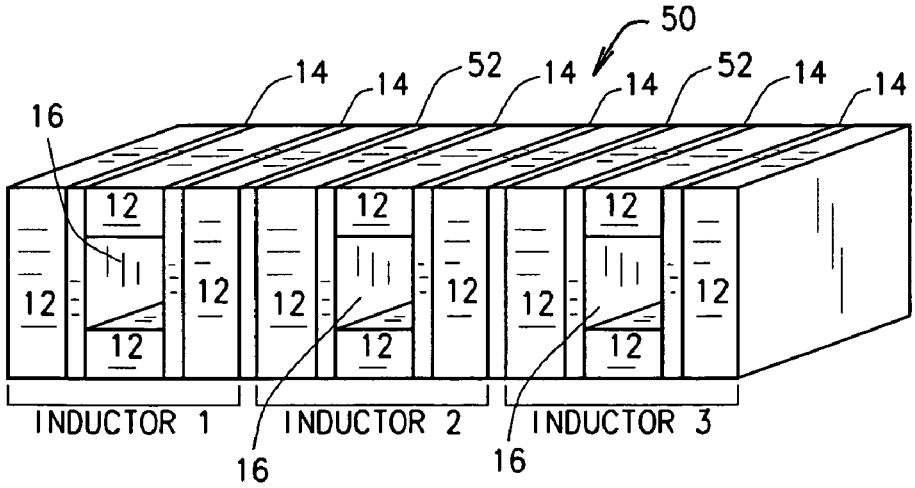
FIG. 6 is a third embodiment of an exemplary core structure.

FIG. 6 is a third embodiment of an exemplary core structure 50 wherein a number of core structures are stacked one above the next and separated by a non-magnetic insulating layer 52. In the illustrated embodiment, each core structure includes two non-magnetic layers 14 sandwiched between magnetic layers 12, and insulating layers 52 extend between each cores structure and are substantially parallel to the layers 12, 14 of each core structure The nonmagnetic layers 14 define opposite sides of the conductor openings 16. The insulating layers 52 may be bonded between stacked layers 12, 14 either before or after openings 16 are formed, and core structure 50 is fired as a monolithic structure into its final form.

While stacked layers 12, 14 of core structure 50 includes three magnetic layers 12 and two non-magnetic layers 14, it is appreciated that greater or fewer numbers of-magnetic layers 14 may be employed with greater or fewer number of magnetic layers 12 without departing from the scope of the present invention. Further, as noted above with respect to the core structure 30, the core structure 50 need not have an overall rectangular shape and need not have rectangular conductor openings to achieve the instant benefits of the invention, and hence in different embodiments a variety of shapes for overall core structure 30 and/or the conductor openings 16 may be employed.

While the embodiments illustrated embodiments are structured to include three magnetic components in a unitary core structure, it is contemplated that greater or fewer than three magnetic components or circuits could be combined into a single structure in further and/or alternative embodiments.

Structural differences aside, the core structure 50 provides approximately the same advantages as core structure 30 (shown in FIG. 5).

While the invention has been described in terms of various specific embodiments, those skilled in the art will recognize that the invention can be practiced with modification within the spirit and scope of the claims.

What is claimed is:

1. A magnetic component comprising:

a first monolithic core structure comprising a plurality of magnetic layers and at least one nonmagnetic layer separating one of said plurality of magnetic layers from another of said plurality of magnetic layers, and a first opening extending through said first core structure; and a conductive element establishing a conductive path through said first opening, wherein said at least one nonmagnetic layer separates said conductive element from one of the magnetic layers.

2. A magnetic component in accordance with claim 1 wherein said conductive element comprises a rectangular conductor.

3. A magnetic component in accordance with claim 1 wherein said conductive element is formed on a surface of said first monolithic core structure.

4. A magnetic component in accordance with claim 1 wherein said first opening is substantially rectangular, said at least one nonmagnetic layer defining one side of said first opening.

5. A magnetic component in accordance with claim 1 wherein said first opening is substantially rectangular, and said at least one nonmagnetic layer comprises a pair of nonmagnetic layers, said pair of nonmagnetic layers defining opposite sides of said first opening.

6. A magnetic component in accordance with claim 1 wherein said nonmagnetic layer extends substantially parallel to said magnetic layers.

7. A magnetic component in accordance with claim 1 wherein said conductive element comprises a plurality of sides and said opening comprises an inner surface defined by said magnetic layers and said at least one nonmagnetic layer, one of said sides of said conductive element extending upon said at least one nonmagnetic layer and the remaining sides of said conductive element being spaced from said inner surface.

8. A magnetic component in accordance with claim 1 further comprising a second core structure monolithically formed with said first core structure, said second core structure comprising:

a plurality of magnetic layers and at least one nonmagnetic layer separating one of said plurality of magnetic layers from another of said plurality of magnetic layers; and a second opening extending through said second core structure for passage of a conductive element.

9. A magnetic component in accordance with claim 8 further comprising an insulating layer monolithically formed with and separating said first core structure and said second core structure.

10. A magnetic component in accordance with claim 9 wherein said insulating layer extends substantially parallel to said magnetic layers.

11. A magnetic component in accordance with claim 9 wherein said insulating layer extends substantially perpendicular to said magnetic layers.

12. A magnetic component in accordance with claim 1 wherein said conductive element is in contact with and supported by said at least one nonmagnetic layer and otherwise substantially centered with respect to said first opening.

13. A magnetic component in accordance with claim 1 wherein said conductive element is located within said opening such that magnetic flux lines of the core structure do not intersect said conductive element.

14. A magnetic component in accordance with claim 1 wherein said conductive element is complementary in shape to said opening.

15. A magnetic component comprising:

a monolithic core comprising a first core structure and a second core structure separated by an insulating layer, each of said first and second core structures comprising a plurality of magnetic layers, at least one nonmagnetic layer separating one of said plurality of magnetic layers from another of said plurality of magnetic layers, and an opening extending therethrough for passage of a conductive element;

wherein each said opening of said first and second core structure is substantially rectangular, said at least one nonmagnetic layer of each of said first and second core structures defining one side of said opening for each respective first and second core structure.

16. A magnetic component in accordance with claim 15 wherein said insulating layer extends substantially parallel to said magnetic layers of at least one of said first and second core structures.

17. A magnetic component in accordance with claim 15 wherein said insulating layer extends substantially perpendicular to said magnetic layers of at least one of said first and second core structures.

18. A magnetic component comprising:

a monolithic core comprising a first core structure and a second core structure separated by an insulating layer, each of said first and second core structures comprising a plurality of magnetic layers, at least one nonmagnetic layer separating one of said plurality of magnetic layers from another of said plurality of magnetic layers, and an opening extending therethrough for passage of a conductive element;

wherein each said opening of said first and second core structures is substantially rectangular and said at least one nonmagnetic layer of each of said first and second core structures comprises a pair of nonmagnetic layers, said pair of nonmagnetic layers defining opposite sides of each said opening for each respective first core structure and said second core structure.

19. A magnetic component comprising:

a monolithic core comprising a first core structure and a second core structure separated by an insulating layer, each of said first and second core structures comprising a plurality of magnetic layers, at least one nonmagnetic layer separating one of said plurality of magnetic layers from another of said plurality of magnetic layers, and an opening extending therethrough for passage of a conductive element; and a conductive element establishing a conductive path through each said opening of each said first core structure and said second core structure, wherein said at least one nonmagnetic layer of said first and second core structures separates said conductive element from one of the magnetic layers.

20. A magnetic component in accordance with claim 18 wherein said insulating layer extends substantially parallel to or substantially perpendicular to said magnetic layers of at least one of said first and second core structures.

21. A magnetic component in accordance with claim 19 wherein said insulating layer extends substantially parallel to or substantially perpendicular to said magnetic layers of at least one of said first and second core structures.

* * * * *